US011710452B2

(12) United States Patent
Chen et al.

(10) Patent No.: US 11,710,452 B2
(45) Date of Patent: Jul. 25, 2023

(54) PIXEL CIRCUIT, PIXEL DRIVING METHOD, DISPLAY PANEL, AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Yipeng Chen, Beijing (CN); Ling Shi, Beijing (CN)

(73) Assignees: CHENGDU BOE OPTOELECTRONICS TECHNOLOGY CO, LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 188 days.

(21) Appl. No.: 17/426,562

(22) PCT Filed: Sep. 25, 2020

(86) PCT No.: PCT/CN2020/117766
§ 371 (c)(1),
(2) Date: Jul. 28, 2021

(87) PCT Pub. No.: WO2022/061718
PCT Pub. Date: Mar. 31, 2022

(65) Prior Publication Data
US 2022/0319420 A1 Oct. 6, 2022

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0426* (2013.01);
(Continued)

(58) Field of Classification Search
CPC ..... G09G 3/3233; G09G 3/3258; G09G 2300/0426; G09G 2300/0819;
(Continued)

(56) References Cited

U.S. PATENT DOCUMENTS 11,011,113 B1 * 5/2021 Lu ..... G09G 3/3225
11,049,457 B1 * 6/2021 Ono ..... G09G 3/3233
(Continued)

FOREIGN PATENT DOCUMENTS

CN 109801592 A 5/2019
CN 111243521 A 6/2020
JP 2006065282 A 3/2006

*Primary Examiner* — Tom V Sheng
(74) *Attorney, Agent, or Firm* — Brooks Kushman P.O.

(57) ABSTRACT

A pixel circuit, is provided, including: a light-emitting element, a driving circuit, a data writing circuit, an on-off control circuit, a first initialization circuit and an energy storage circuit; the data writing circuit writes a data voltage into a third node under control of a first gate driving signal; the on-off control circuit controls communication between a first node and the third node under the control of the first gate driving signal; the first initialization circuit controls writing an initialization voltage into the first node under the control of the first gate driving signal; and a type of a transistor included in the first initialization circuit is different from a type of a driving transistor included in the driving circuit, and a type of a transistor included in the data writing circuit is different from the type of the driving transistor of the driving circuit.

18 Claims, 5 Drawing Sheets

(52) U.S. Cl.
CPC ..... *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2310/08* (2013.01); *G09G 2320/0233* (2013.01); *G09G 2320/043* (2013.01); *G09G 2320/045* (2013.01)

(58) Field of Classification Search
CPC ... G09G 2300/0842; G09G 2300/0861; G09G 2310/08; G09G 2310/0251; G09G 2310/0262; G09G 2320/0233; G09G 2320/043; G09G 2320/045
USPC ..... 345/691
See application file for complete search history.

(56) References Cited

U.S. PATENT DOCUMENTS

2006/0055336 A1 3/2006 Jeong
2016/0042694 A1* 2/2016 Lim ..... G09G 3/3233 345/78
2018/0047337 A1 2/2018 Zhu et al.
2018/0218681 A1* 8/2018 Cai ..... H10K 59/131
2018/0226018 A1* 8/2018 Han ..... H10K 59/12
2018/0277037 A1* 9/2018 Lin ..... G09G 3/3275
2019/0073953 A1* 3/2019 Kuang ..... G09G 3/3233
2019/0131376 A1* 5/2019 Hong ..... H10K 59/131
2019/0156747 A1* 5/2019 Nie ..... G09G 3/3233
2019/0266943 A1* 8/2019 Gao ..... G09G 3/3233
2020/0226978 A1* 7/2020 Lin ..... G09G 3/3258
2020/0342813 A1* 10/2020 Gao ..... G09G 3/3291
2020/0410934 A1* 12/2020 Jeon ..... G09G 3/3283
2021/0020104 A1* 1/2021 Lu ..... G09G 3/3266
2021/0090502 A1* 3/2021 Choi ..... G09G 3/3258
2021/0142733 A1* 5/2021 Kim ..... G09G 3/3233
2021/0305353 A1* 9/2021 Ono ..... H10K 59/124
2021/0407390 A1* 12/2021 Li ..... G09G 3/3233
2022/0028338 A1* 1/2022 Yang ..... G09G 3/3233
2022/0108655 A1* 4/2022 Yu ..... G09G 3/3233
2022/0139315 A1* 5/2022 Lin ..... G09G 3/3233 345/691
2022/0157238 A1* 5/2022 Wang ..... G09G 3/3233
2022/0165814 A1* 5/2022 Rieutort-Louis ..... H10K 59/60
2023/0034225 A1* 2/2023 Tanaka ..... G09G 3/3241

* cited by examiner

PIXEL CIRCUIT, PIXEL DRIVING METHOD, DISPLAY PANEL, AND DISPLAY DEVICE

CROSS-REFERENCE TO RELATED APPLICATION

This application is the U.S. national phase of PCT Application No. PCT/CN2020/117766 filed on Sep. 25, 2020, which is incorporated herein by reference in its entirety.

TECHNICAL FIELD

The present disclosure relates to the field of display technology, and more particularly, to a pixel circuit, a pixel driving method, a display panel, and a display device.

BACKGROUND

A related pixel circuit applied to a display device generally adopts LTPS (Low Temperature Poly-Silicon) technology, has a high driving power, and cannot reduce a leakage current of a transistor electrically connected to a control terminal of the driving circuit while compensating for a threshold voltage of a driving transistor, so that the potential of the control terminal of the driving circuit cannot be ensured to be stable.

SUMMARY

In one aspect, an embodiment of the present disclosure provides a pixel circuit, including a light-emitting element, a driving circuit, a data writing circuit, an on-off control circuit, a first initialization circuit, and an energy storage circuit;

a control terminal of the driving circuit is electrically connected to a first node, a first terminal of the driving circuit is electrically connected to a second node, and a second terminal of the driving circuit is electrically connected to the light-emitting element; and the driving circuit is used for generating a drive current for driving the light-emitting element to emit light under the control of the potential of the control terminal of the driving circuit;

a first terminal of the energy storage circuit is electrically connected to the second node, a second terminal of the energy storage circuit is electrically connected to a third node, and the energy storage circuit is used for storing energy;

the data writing circuit is electrically connected to a first gate line, a data line and the third node, and is used for writing data voltage on the data line into the third node under the control of a first gate driving signal provided by the first gate line;

the on-off control circuit is electrically connected to the first gate line, the first node and the third node, and is used for controlling communication between the first node and the third node under the control of the first gate driving signal;

the first initialization circuit is electrically connected to the first gate line, the first node and an initialization voltage terminal, and is used for controlling writing an initialization voltage provided by the initialization voltage terminal into the first node under the control of the first gate driving signal; and a type of a transistor included in the first initialization circuit is different from a type of a driving transistor included in the driving circuit, and a type of a transistor included in the data writing circuit is different from the type of the driving transistor included in the driving circuit.

Optionally, the driving transistor is a low temperature polysilicon transistor, and the transistor included in the first initialization circuit and the transistor included in the data writing circuit are both oxide transistors.

Optionally, a type of a transistor included in the on-off control circuit is the same as the type of the driving transistor included in the driving circuit.

Optionally, the pixel circuit of at least one embodiment of the present disclosure further includes a second initialization circuit; a second terminal of the driving circuit is electrically connected to a first electrode of the light-emitting element, and a second electrode of the light-emitting element is electrically connected to a first voltage terminal; and the second initialization circuit is electrically connected to a second gate line, the initialization voltage terminal and the first electrode of the light-emitting element, and is used for writing the initialization voltage into the first electrode of the light-emitting element under the control of a second gate driving signal provided by the second gate line, so as to control the light-emitting element not to emit light.

Optionally, a type of a transistor included in the second initialization circuit is the same as the type of the driving transistor.

Optionally, the pixel circuit of at least one embodiment of the present disclosure further includes a first light-emitting control circuit; and the first light-emitting control circuit is electrically connected to the second node, a power supply voltage terminal and a first light-emitting control line, and is used for controlling communication between the power supply voltage terminal and the second node under the control of a first light-emitting control signal provided by the first light-emitting control line.

Optionally, the pixel circuit of at least one embodiment of the present disclosure further includes a second light-emitting control circuit; the second terminal of the driving circuit is electrically connected to the light-emitting element via the second light-emitting control circuit; and the second lighting control circuit is also electrically connected to a second light-emitting control line, and is used for controlling communication between the second terminal of the driving circuit and the light-emitting element under the control of a second light-emitting control signal provided by the second light-emitting control line.

Optionally, the driving circuit includes a driving transistor, the data writing circuit includes a data writing transistor, the on-off control circuit includes an on-off control transistor, the first initialization circuit includes a first initialization transistor, and the energy storage circuit includes a storage capacitor;

a control electrode of the driving transistor is electrically connected to the first node, a first electrode of the driving transistor is electrically connected to the second node, and a second electrode of the driving transistor is electrically connected to the light-emitting element;

a first terminal of the storage capacitor is electrically connected to the second node, and a second terminal of the storage capacitor is electrically connected to a third node;

a control electrode of the data writing transistor is electrically connected to the first gate line, a first electrode of the data writing transistor is electrically connected to the data line, and a second electrode of the data writing transistor is electrically connected to the third node;

a control electrode of the on-off control transistor is electrically connected to the first gate line, a first electrode of the on-off control transistor is electrically connected to the third node, and a second electrode of the on-off control transistor is electrically connected to the first node; and a control electrode of the first initialization transistor is electrically connected to the first gate line, a first electrode of the first initialization transistor is electrically connected to the initialization voltage terminal, and a second electrode of the first initialization transistor is electrically connected to the first node.

Optionally, the second initialization circuit includes a second initialization transistor;

a control electrode of the second initialization transistor is electrically connected to the second gate line, a first electrode of the second initialization transistor is electrically connected to an initialization voltage terminal, and a second electrode of the second initialization transistor is electrically connected to a first electrode of the light-emitting element; and the second initialization transistor is a low temperature polysilicon transistor.

Optionally, the first light-emitting control circuit includes a first light-emitting control transistor;

a control electrode of the first light-emitting control transistor is electrically connected to the first light-emitting control line, a first electrode of the first light-emitting control transistor is electrically connected to the power supply voltage terminal, and a second electrode of the first light-emitting control transistor is electrically connected to the second node; and the first light-emitting control transistor is a low temperature polysilicon transistor.

Optionally, the second light-emitting control circuit includes a second light-emitting control transistor;

a control electrode of the second light-emitting control transistor is electrically connected to the second light-emitting control line, a first electrode of the second light-emitting control transistor is electrically connected to a second terminal of the driving circuit, and a second electrode of the second light-emitting control transistor is electrically connected to the light-emitting element; and the second light-emitting control transistor is a low temperature polysilicon transistor.

In a second aspect, an embodiment of the present disclosure further provides a pixel driving method applied to the above-mentioned pixel circuit, a display cycle including a compensation phase and a writing phase in sequence; the pixel driving method including:

in the compensation phase, a data writing circuit writes data voltage on a data line into a third node under the control of a first gate driving signal; a first initialization circuit writes an initialization voltage V0 into a first node under the control of the first gate driving signal; an energy storage circuit is charged by the data voltage so that the potential of a second node eventually becomes V0−Vth, where Vth is a threshold voltage of a driving transistor included in a driving circuit; and in the writing phase, an on-off control circuit controls communication between the first node and the third node under the control of the first gate driving signal to write the data voltage to the first node.

Optionally, the pixel circuit further includes a first light-emitting control circuit; the display cycle further includes a light-emitting phase after the writing phase; the pixel driving method further includes: in the compensation phase, the driving circuit controls communication between a first terminal of the driving circuit and a second terminal of the driving circuit under the control of the initialization voltage V0 input into a control terminal of the driving circuit, the energy storage circuit is charged by the data voltage so as to change the potential of the second node until the potential of the second node becomes V0−Vth, and the driving circuit disconnects the connection between the first terminal of the driving circuit and the second terminal of the driving circuit; and in the light-emitting phase, the first light-emitting control circuit controls communication between a power supply voltage terminal and the second node under the control of a first light-emitting control signal, the on-off control circuit controls communication between the first node and the third node under the control of the first gate driving signal, and the driving circuit controls the generation of a drive current for driving the light-emitting element to emit light under the control of the potential of the control terminal of the driving circuit.

Optionally, the pixel circuit further includes a first light-emitting control circuit and a second light-emitting control circuit; the display cycle further includes a light-emitting phase after the writing phase; the compensation phase includes a first compensation period and a second compensation period; and the pixel driving method further includes:

in the first compensation time period, the first light-emitting control circuit controls communication between the power supply voltage terminal and the second node under the control of the first light-emitting control signal so as to write a power supply voltage into the second node;

in the second compensation time period, the second light-emitting control circuit controls communication between the second terminal of the driving circuit and the light-emitting element under the control of a second light-emitting control signal, and the driving circuit controls communication between the first terminal of the driving circuit and the second terminal of the driving circuit under the control of the initialization voltage V0 input into the control terminal of the driving circuit, the energy storage circuit is charged by the data voltage so as to change the potential of the second node until the potential of the second node becomes V0−Vth, and the driving circuit disconnects the connection between the first terminal of the driving circuit and the second terminal of the driving circuit;

in the writing phase, the second light-emitting control circuit controls communication between the second terminal of the driving circuit and the light-emitting element under the control of the second light-emitting control signal; and in the light-emitting phase, the first light-emitting control circuit controls communication between the power supply voltage terminal and the second node under the control of the first light-emitting control signal, the second light-emitting control circuit controls the conduction between the second terminal of the driving circuit and the light-emitting element under the control of the second light-emitting control signal, and the driving circuit drives the light-emitting element to emit light.

Optionally, the pixel circuit further includes a second initialization circuit; the pixel driving method further includes:

in the compensation phase, the second initialization circuit writes an initialization voltage into a first electrode of the light emitting element under the control of the second gate driving signal, so as to control the light emitting element not to emit light.

In a third aspect, the present disclosure further provides a display panel including the above-mentioned pixel circuit.

In a fourth aspect, the present disclosure further provides a display device including the above-mentioned display panel.

DETAILED DESCRIPTION

The technical solutions of the embodiments of the present disclosure will now be described in a clear and complete manner in conjunction with the drawings in the embodiments of the present disclosure. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

The transistors used in all embodiments of the present disclosure may be triodes, thin film transistors or field effect transistors or other devices with the same characteristics. In embodiments of the present disclosure, to distinguish between two electrodes of a transistor other than a control electrode, one of the electrodes is referred to as a first electrode and the other electrode is referred to as a second electrode.

In practical operation, when the transistor is a triode, the control electrode can be a base electrode, the first electrode can be a collector electrode, and the second electrode can be an emitter electrode; optionally, the control electrode may be a base electrode, the first electrode may be an emitter electrode, and the second electrode may be a collector electrode.

In practical operation, when the transistor is a thin film transistor or a field effect transistor, the control electrode can be a gate electrode, the first electrode can be a drain electrode, and the second electrode can be a source electrode; optionally, the control electrode may be a gate electrode, the first electrode may be a source electrode, and the second electrode may be a drain electrode.

Figure 1:
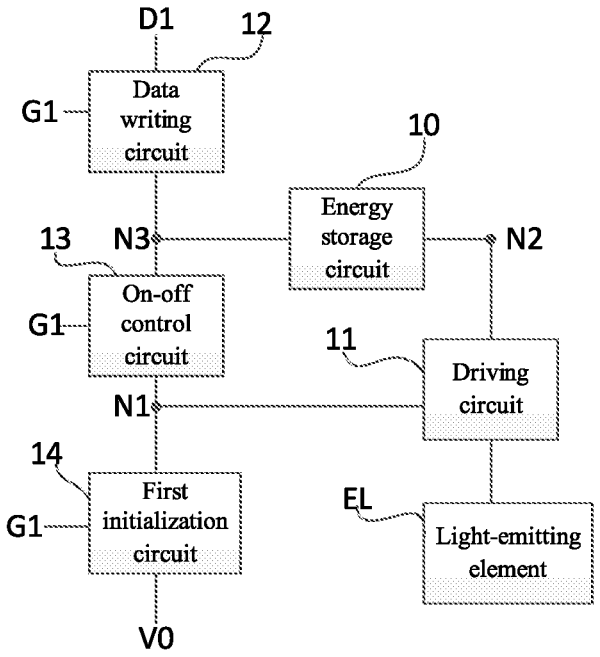
FIG. 1 is a block diagram of a pixel circuit according to at least one embodiment of the present disclosure.

As shown in FIG. 1, the pixel circuit according to at least one embodiment of the present disclosure includes a light-emitting element EL, a driving circuit 11, a data writing circuit 12, an on-off control circuit 13, a first initialization circuit 14 and an energy storage circuit 10.

A control terminal of the driving circuit 11 is electrically connected to a first node N1, a first terminal of the driving circuit 11 is electrically connected to a second node N2, and a second terminal of the driving circuit 11 is electrically connected to the light-emitting element EL; the driving circuit 11 is used for generating a drive current for driving the light-emitting element EL to emit light under the control of the potential of the control terminal thereof.

A first terminal of the energy storage circuit 10 is electrically connected to the second node N2, a second terminal of the energy storage circuit 10 is electrically connected to a third node N3, and the energy storage circuit 10 is used for storing energy.

The data writing circuit 12 is electrically connected to the first gate line G1, the data line D1 and the third node N3 for writing the data voltage on the data line D1 into the third node N3 under control of a first gate driving signal provided by the first gate line G1.

The on-off control circuit 13 is electrically connected to the first gate line G1, the first node N1 and the third node N3 for controlling the communication between the first node N1 and the third node N3 under the control of the first gate driving signal.

The first initialization circuit 14 is electrically connected to the first gate line G1, the first node N1 and an initialization voltage terminal, and is used for controlling to write an initialization voltage V0 provided by the initialization voltage terminal into the first node N1 under the control of the first gate driving signal.

The first initialization circuit 14 includes a transistor of a type different from a driving transistor of the driving circuit 11, and the data writing circuit 12 includes a transistor of a type different from that of the driving transistor of the driving circuit 11.

In a specific implementation, the transistor included in the first initialization circuit 14 and the transistor included in the data writing circuit 12 may both be oxide transistors, and the transistors included in the on-off control circuit 13 and the driving transistor may both be LTPS (Low Temperature Poly-Silicon) transistors, but this is not limited herein.

In actual operation, the transistors included in the first initialization circuit 14 and the transistors included in the data writing circuit 12 are set as oxide transistors, and since the leakage current of the oxide transistors is small, the stability of the potential of N1 can be ensured.

The pixel circuit according to at least one embodiment of the present disclosure can write the threshold voltage of the driving transistor to the second node N2 in a source-following manner, and then write the threshold voltage to the first node N1 through a jump of the potential of the second node N2, and finally compensation for the threshold voltage of the driving transistor can be achieved.

The pixel circuit described in the present disclosure is an LTPO (Low Temperature Polycrystalline Oxide) pixel circuit, and the driving power may be reduced.

In the related art, the LTPO pixel circuit has a lower driving power than the LTPS pixel circuit. The LTPS pixel circuit requires a scanning frequency of up to 60 Hz to display a still image, and the LTPO pixel circuit requires only a lower scanning frequency (for example, the scanning frequency may be 1 Hz) to display a still image, and the driving frequency may be greatly reduced.

Optionally, the driving transistor is a low temperature polysilicon transistor, and the transistor included in the first initialization circuit and the transistor included in the data writing circuit are both oxide transistors.

In a specific implementation, the on-off control circuit may include a transistor of the same type as the driving transistor of the driving circuit, but is not limited thereto.

In at least one embodiment of the present disclosure, the pixel circuit further includes a second initialization circuit; a second terminal of the driving circuit is electrically connected to a first electrode of the light-emitting element, and a second electrode of the light-emitting element is electrically connected to a first voltage terminal; and the second initialization circuit is electrically connected to the second gate line, the initialization voltage terminal and the first electrode of the light-emitting element, and is used for writing the initialization voltage into the first electrode of the light-emitting element under the control of the second gate driving signal provided by the second gate line, so as to control the light-emitting element not to emit light.

In at least one embodiment of the present disclosure, the first voltage terminal may be, but is not limited to, a ground terminal or a low voltage terminal.

Figure 2:
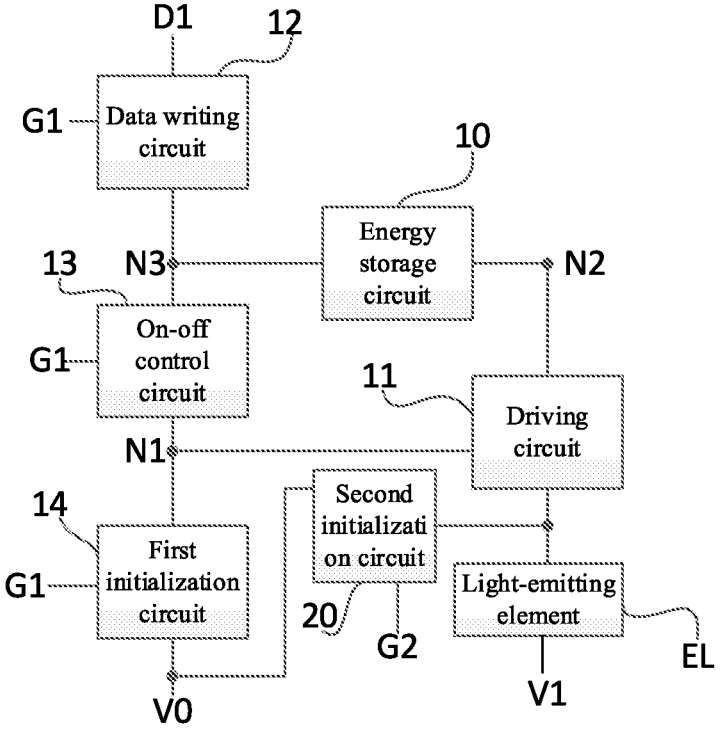
FIG. 2 is a block diagram of a pixel circuit according to at least one embodiment of the present disclosure.

As shown in FIG. 2, on the basis of at least one embodiment of the pixel circuit shown in FIG. 1, the pixel circuit according to at least one embodiment of the present disclosure may further include a second initialization circuit 20.

A second terminal of the driving circuit 11 is electrically connected to a first electrode of the light-emitting element EL, and a second electrode of the light-emitting element EL is electrically connected to a first voltage terminal V1.

The second initialization circuit 20 is electrically connected to the second gate line G2, the initialization voltage terminal and the first electrode of the light-emitting element EL, and is used for writing the initialization voltage V0 into the first electrode of the light-emitting element EL under the control of the second gate driving signal provided by the second gate line G2, so as to control the light-emitting element EL not to emit light.

When at least one embodiment of the pixel circuit according to the present disclosure as shown in FIG. 2 operates, in a compensation phase, a second initialization circuit 20 writes the initialization voltage V0 into a first electrode of the light-emitting element EL under the control of a second gate driving signal provided by the second gate line G2, so as to control the light-emitting element EL not to emit light.

In a specific implementation, the light-emitting element EL may be an organic light-emitting diode, the first electrode of the light-emitting element EL may be an anode of the organic light-emitting diode, and the second electrode of the light-emitting element EL may be a cathode of the organic light-emitting diode, but this is not limited herein.

Optionally, the second initialization circuit includes a transistor of the same type as the driving transistor.

For example, the transistor included in the second initialization circuit may be a low temperature polysilicon transistor, but is not limited thereto.

Figure 3:
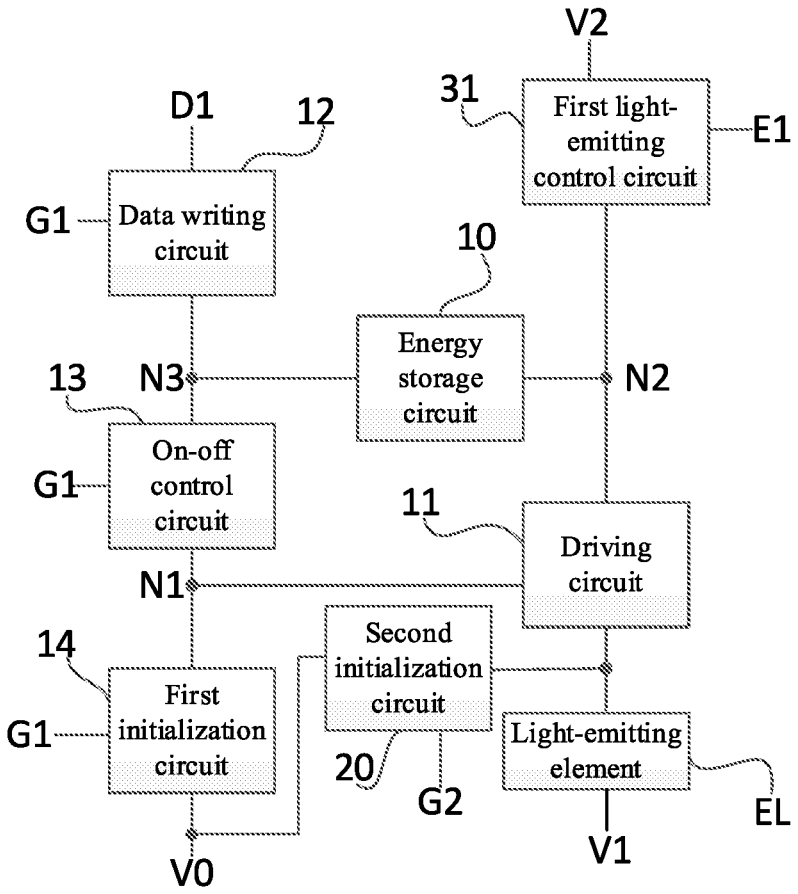
FIG. 3 is a block diagram of a pixel circuit according to at least one embodiment of the present disclosure.

In a specific implementation, as shown in FIG. 3, on the basis of at least one embodiment of the pixel circuit shown in FIG. 2, the pixel circuit according to at least one embodiment of the present disclosure further includes a first light-emitting control circuit 31; and the first light-emitting control circuit 31 is electrically connected to the second node N2, a power supply voltage terminal V2 and a first light-emitting control line E1, and is used for controlling the communication between the power supply voltage terminal V2 and the second node N2 under the control of a first light-emitting control signal provided by the first light-emitting control line E1.

At least one embodiment of the pixel circuit of the present disclosure as shown in FIG. 3, in operation, the display cycle includes a compensation phase, a writing phase and a light-emitting phase which are arranged in sequence.

In the compensation phase, the data writing circuit writes the data voltage on the data line into the third node under the control of the first gate driving signal; a first initialization circuit writes an initialization voltage V0 into a first node under the control of the first gate driving signal; a second initialization circuit writes the initialization voltage V0 into a first electrode of the light-emitting element under the control of a second gate driving signal provided by the second gate line so as to control the light-emitting element not to emit light; a driving circuit controls communication between a first terminal of the driving circuit and a second terminal of the driving circuit under the control of an initialization voltage V0 connected to a control terminal thereof, charges an energy storage circuit via the data voltage so as to change the potential of a second node until the potential of the second node becomes V0−Vth, and the driving circuit disconnects the connection between the first terminal and the second terminal of the driving circuit;

In a writing phase, an on-off control circuit controls communication between the first node and the third node under the control of a first gate driving signal so as to write the data voltage into the first node.

In the light-emitting phase, the first light-emitting control circuit controls the communication between the power supply voltage terminal and the second node under the control of the first light-emitting control signal, the on-off control circuit controls the communication between the first node and the third node under the control of the first gate driving signal, and the driving circuit controls the generation of the drive current for driving the light-emitting element to emit light under the control of the potential of the control terminal thereof.

Optionally, the pixel circuit according to at least one embodiment of the present disclosure may further include a second light-emitting control circuit. A second terminal of the driving circuit is electrically connected to the light-emitting element via the second light-emitting control circuit.

The second lighting control circuit is also electrically connected to a second light-emitting control line for controlling communication between the second terminal of the driving circuit and the light-emitting element under control of a second light-emitting control signal provided by the second light-emitting control line.

In a specific implementation, a pixel circuit according to at least one embodiment of the present disclosure may include two light-emitting control circuits to control a path through which a driving circuit drives a light emitting element to emit light.

Figure 4:
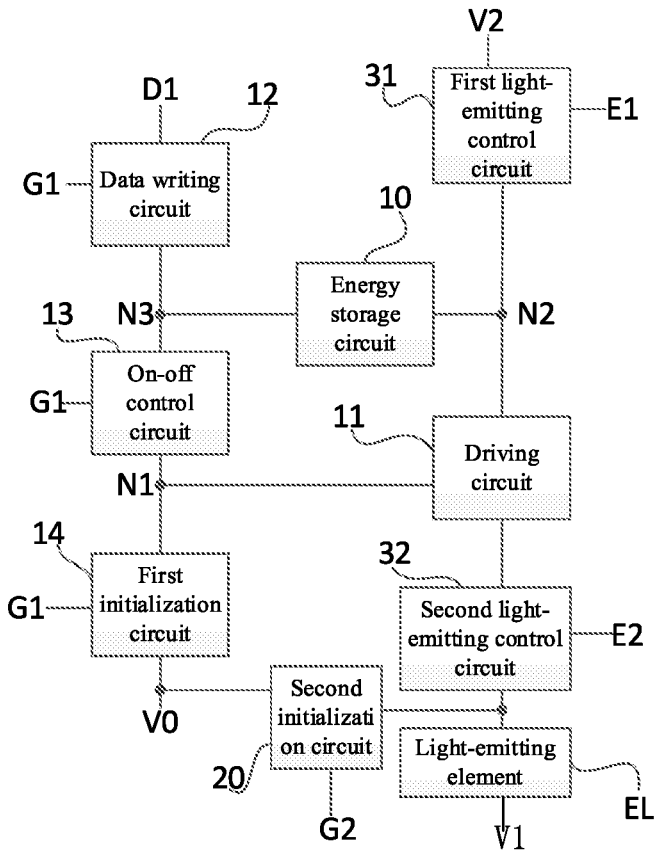
FIG. 4 is a block diagram of a pixel circuit according to at least one embodiment of the present disclosure.

In a specific implementation, as shown in FIG. 4, on the basis of at least one embodiment of the pixel circuit shown in FIG. 2, the pixel circuit according to at least one embodiment of the present disclosure further includes a first light-emitting control circuit 31 and a second light-emitting control circuit 32.

The first light-emitting control circuit 31 is electrically connected to the second node N2, a power supply voltage terminal V2 and a first light-emitting control line E1 for controlling the communication between the power supply voltage terminal V2 and the second node N2 under the control of a first light-emitting control signal provided by the first light-emitting control line E1.

The second light-emitting control circuit 32 is electrically connected to a second light-emitting control line E2, a second terminal of the driving circuit 11 and a first electrode of the light-emitting element EL, and is used for controlling the communication between the second terminal of the driving circuit 11 and the first electrode of the light-emitting element EL under the control of the second light-emitting control signal provided by the second light-emitting control line.

When at least one embodiment of the pixel circuit of the present disclosure as shown in FIG. 4 operates, the display cycle further includes a compensation phase, a writing phase and a light-emitting phase which are arranged in sequence;

the compensation phase includes a first compensation period and a second compensation period.

In the compensation phase, the data writing circuit 12 writes the data voltage Vd on the data line into the third node N3 under the control of the first gate driving signal; a first initialization circuit 14 writes an initialization voltage V0 into a first node N1 under the control of the first gate driving signal; a second initialization circuit writes the initialization voltage V0 into a first electrode of the light-emitting element under the control of the second gate driving signal provided by the second gate line so as to control the light-emitting element not to emit light.

In the first compensation time period, the first light-emitting control circuit 31 controls the communication between the power supply voltage terminal V2 and the second node N2 under the control of the first light emitting-control signal; the second light-emitting control circuit 32 controls the disconnection between the second terminal of the driving circuit 11 and the first electrode of the light-emitting element EL under the control of the second light-emitting control signal.

In the second compensation time period and the writing phase, the first light-emitting control circuit 31 controls the disconnection between the power supply voltage terminal V2 and the second node N2 under the control of the first light-emitting control signal; the second light-emitting control circuit 32 controls the conduction between the second terminal of the driving circuit 11 and the first electrode of the light-emitting element EL under the control of the second light-emitting control signal.

In the second compensation time period, the driving circuit 11 controls the communication between a first terminal of the driving circuit 11 and a second terminal of the driving circuit 11 under the control of the initialization voltage V0 connected to a control terminal thereof, charges the energy storage circuit 10 via the data voltage Vd so as to change the potential of the second node N2 until the potential of the second node N2 becomes V0−Vth, and the driving circuit 11 disconnects the connection between the first terminal and the second terminal of the driving circuit 11.

In the light-emitting phase, the first light-emitting control circuit 31 controls communication between the power supply voltage terminal V2 and the second node N2 under the control of a first light-emitting control signal provided by the first light-emitting control line E1, and the second light-emitting control circuit 32 controls conduction between the second terminal of the driving circuit 11 and the first electrode of the light-emitting element EL under the control of the second light-emitting control signal, so that the driving circuit 11 can drive the light-emitting element EL to emit light.

In particular implementation, the driving circuit may include a driving transistor, the data writing circuit may include a data writing transistor, the on-off control circuit may include an on-off control transistor, the first initialization circuit may include a first initialization transistor, and the energy storage circuit may include a storage capacitor.

A control electrode of the driving transistor is electrically connected to the first node, a first electrode of the driving transistor is electrically connected to the second node, and a second electrode of the driving transistor is electrically connected to the light-emitting element.

A first terminal of the storage capacitor is electrically connected to the second node, and a second terminal of the storage capacitor is electrically connected to a third node.

A control electrode of the data writing transistor is electrically connected to the first gate line, a first electrode of the data writing transistor is electrically connected to the data line, and a second electrode of the data writing transistor is electrically connected to the third node.

A control electrode of the on-off control transistor is electrically connected to the first gate line, a first electrode of the on-off control transistor is electrically connected to the third node, and a second electrode of the on-off control transistor is electrically connected to the first node.

A control electrode of the first initialization transistor is electrically connected to the first gate line, a first electrode of the first initialization transistor is electrically connected to the initialization voltage terminal, and a second electrode of the first initialization transistor is electrically connected to the first node.

Optionally, the second initialization circuit includes a second initialization transistor.

A control electrode of the second initialization transistor is electrically connected to the second gate line, a first electrode of the second initialization transistor is electrically connected to an initialization voltage terminal, and a second electrode of the second initialization transistor is electrically connected to a first electrode of the light-emitting element.

The second initialization transistor is a low temperature polysilicon transistor.

Optionally, the first light-emitting control circuit includes a first light-emitting control transistor.

A control electrode of the first light-emitting control transistor is electrically connected to the first light-emitting control line, a first electrode of the first light-emitting control transistor is electrically connected to the power supply voltage terminal, and a second electrode of the first light-emitting control transistor is electrically connected to the second node.

The first light-emitting control transistor is a low temperature polysilicon transistor.

Optionally, the second light-emitting control circuit includes a second light-emitting control transistor.

A control electrode of the second light-emitting control transistor is electrically connected to the second light-emitting control line, a first electrode of the second light-emitting control transistor is electrically connected to a second terminal of the driving circuit, and a second electrode of the second light-emitting control transistor is electrically connected to the light-emitting element.

The second light-emitting control transistor is a low temperature polysilicon transistor.

Figure 5:
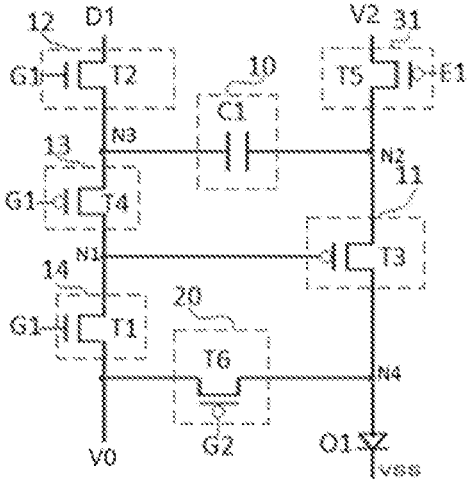
FIG. 5 is a circuit diagram of a pixel circuit according to at least one embodiment of the present disclosure.

As shown in FIG. 5, the pixel circuit of at least one embodiment of the present disclosure includes an organic light-emitting diode O1, a driving circuit 11, a data writing circuit 12, an on-off control circuit 13, a first initialization circuit 14, an energy storage circuit 10, a second initialization circuit 20 and a first light-emitting control circuit 31.

The driving circuit 11 includes a driving transistor T3, the data writing circuit 12 includes a data writing transistor T2, the on-off control circuit 13 includes an on-off control transistor T4, the first initialization 14 may include a first initialization transistor T1, and the energy storage circuit 10 includes a storage capacitor C1; the second initialization circuit 20 includes a second initialization transistor T6, and the first light-emitting control circuit 31 includes a first light-emitting control transistor T5.

A gate electrode of the driving transistor T3 is electrically connected to the first node N1, a source electrode of the driving transistor T3 is electrically connected to the second node N2, and a drain electrode of the driving transistor T3 is electrically connected to an anode of O1; a cathode of O1 is connected to a low voltage VSS.

A first terminal of the storage capacitor C1 is electrically connected to the second node N2, and a second terminal of the storage capacitor C1 is electrically connected to the third node N3.

A gate electrode of the data writing transistor T2 is electrically connected to the first gate line G1, a drain electrode of the data writing transistor T2 is electrically connected to the data line D1, and a source electrode of the data writing transistor T2 is electrically connected to the third node N3.

A gate electrode of the on-off control transistor T4 is electrically connected to the first gate line G1, a source electrode of the on-off control transistor T4 is electrically connected to the third node N3, and a drain electrode of the on-off control transistor T4 is electrically connected to the first node N1.

A gate electrode of the first initialization transistor T1 is electrically connected to the first gate line G1, a drain electrode of the first initialization transistor T1 is electrically connected to the initialization voltage terminal, and a source electrode of the first initialization transistor T1 is electrically connected to the first node N1; the initialization voltage terminal is used for providing an initialization voltage V0.

A gate electrode of the second initialization transistor T6 is electrically connected to the second gate line G2, a source electrode of the second initialization transistor T6 is electrically connected to a drain electrode of the driving transistor T3, and the source electrode of the second initialization transistor T6 is electrically connected to the anode of O1.

A gate electrode of the first light-emitting control transistor T5 is electrically connected to the first light-emitting control line E1, a source electrode of the first light-emitting control transistor T5 is electrically connected to the power supply voltage terminal V2, and a drain electrode of the first light-emitting control transistor T5 is electrically connected to the second node N2; the power supply voltage terminal V2 is used to provide a power supply voltage V02.

In FIG. 5, the node labeled N4 is the fourth node electrically connected to the anode of O1.

In the pixel circuit of at least one embodiment of the present disclosure shown in FIGS. 5, T1 and T2 are n-type transistors, and T3, T4, T5, and T6 are p-type transistors.

T1 and T2 are oxide transistors, and T3, T4, T5 and T6 are low temperature polysilicon transistors.

In a specific implementation, T1 and T2 are set as oxide transistors, and the leakage current of the oxide transistors is small, so that the potential of N1 and the potential of N3 can be well maintained during the light-emitting phase.

When at least one embodiment of the pixel circuit of the present disclosure as shown in FIG. 5 operates, three scanning signals (the three scanning signals may be: the first gate driving signal are employed, the second gate driving signal and the first light emitting-control signal), and threshold voltage compensation and light emission can be realized.

Figure 6:
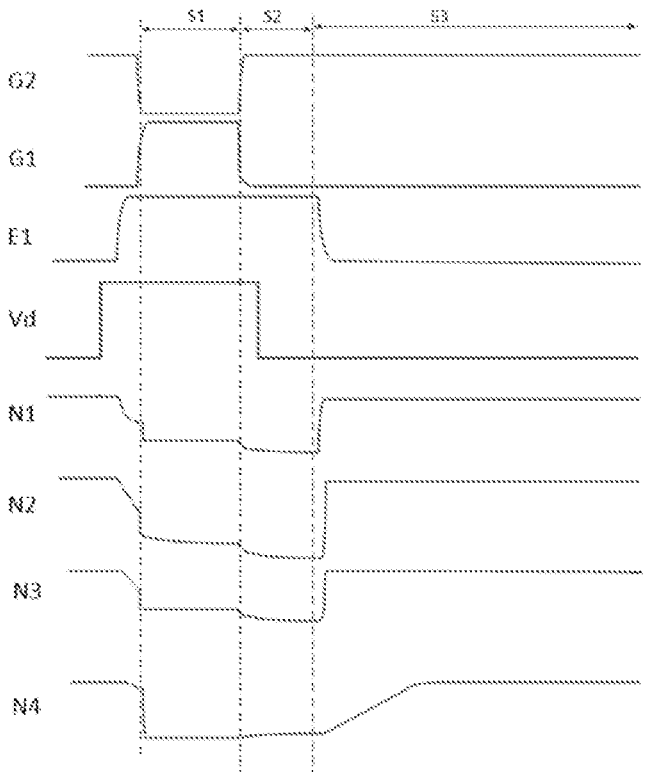
FIG. 6 is a timing diagram illustrating the operation of at least one embodiment of the pixel circuit shown in FIG. 5.

As shown in FIG. 6, in operation of at least one embodiment of the pixel circuit shown in FIG. 5 of the present disclosure, the display cycle may include a compensation phase S1, a writing phase S2 and a light-emitting phase S3 arranged in sequence.

In the compensation phase S1, G2 provides a low voltage signal, G1 provides a high voltage signal, E1 provides a high voltage signal, a data line D1 provides a data voltage Vd, T2 is on, T1 is on and T6 is on, so as to provide V0 to the anode of O1, so that O1 does not emit light; and the data voltage Vd provided by the data line D1 is provided to N3, and V0 is provided to N1 and N4, so that the potential of N1 is V0, and the potential of N3 is Vd; at the beginning of the compensation phase S1, T3 can be turned on, Vd charges C1 via T2 which is turned on so as to raise the potential of N2 until the potential of N2 becomes V0−Vth, T3 is turned off and charging is stopped, and the potential of N2 remains V0−Vth, where Vth is a threshold voltage of T3.

In the writing phase S2, G2 provides a high voltage signal, G1 provides a low voltage signal, E1 provides a high voltage signal, T6 is off, T4 is on, and N1 is in communication with N3 so as to write a data voltage Vd into N1, the potential of N1 becomes Vd, and the potential of N2 remains V0−Vth.

In the light-emitting phase S3, G2 provides a high voltage signal, G1 provides a low voltage signal, E1 provides a low voltage signal, T6 is off, T4 is on, N1 is in communication with N3, and T5 is on, so that the potential of N2 jumps to V02; since a voltage difference across both ends of C1 cannot be abruptly changed, the potential of N1 and the potential of N3 both become Vd+V02−V0+Vth; T3 is turned on to drive O1 to emit light.

In the light-emitting phase S3, the current value I1 of the drive current flowing through T3 is as follows:

I1=K(Vd−V0)2; where K is a current coefficient of T3.

It can be seen from the formula of I1 that the current value I1 of the drive current is independent of Vth and V02, and the threshold voltage can be compensated and the drive current can be made independent of the power supply voltage.

Figure 7:
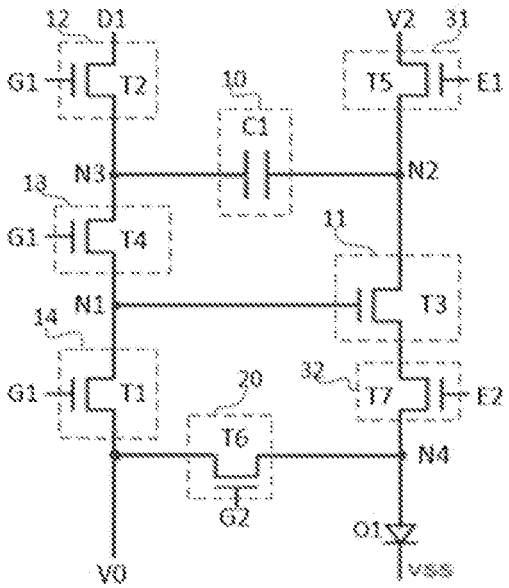
FIG. 7 is a circuit diagram of a pixel circuit according to at least one embodiment of the present disclosure.

As shown in FIG. 7, the pixel circuit of at least one embodiment of the present disclosure includes an organic light-emitting diode, a driving circuit 11, a data writing circuit 12, an on-off control circuit 13, a first initialization circuit 14, an energy storage circuit 10, a second initialization circuit 20, a first light-emitting control circuit 31 and a second light-emitting control circuit 32.

The driving circuit 11 includes a driving transistor T3, the data writing circuit 12 includes a data writing transistor T2, the on-off control circuit 13 includes an on-off control transistor T4, the first initialization circuit 14 includes a first initialization transistor T1, and the energy storage circuit 10 includes a storage capacitor C1; the second initialization circuit 20 includes a second initialization transistor T6; the first light-emitting control circuit 31 includes a first light-emitting control transistor T5; the second light-emitting control circuit 31 includes a second light-emitting control transistor T7.

A gate electrode of the driving transistor T3 is electrically connected to the first node N1, a source electrode of the driving transistor T3 is electrically connected to the second node N2, and a drain electrode of the driving transistor T3 is electrically connected to a source electrode of T7.

A first terminal of the storage capacitor C1 is electrically connected to the second node N2, and a second terminal of the storage capacitor C1 is electrically connected to the third node N3.

A gate electrode of the data writing transistor T2 is electrically connected to the first gate line G1, a drain electrode of the data writing transistor T2 is electrically connected to the data line D1, and a source electrode of the data writing transistor T2 is electrically connected to the third node N3.

A gate electrode of the on-off control transistor T4 is electrically connected to the first gate line G1, a source electrode of the on-off control transistor T4 is electrically connected to the third node N3, and a drain electrode of the on-off control transistor T4 is electrically connected to the first node N1.

A gate electrode of the first initialization transistor T1 is electrically connected to the first gate line G1, a drain electrode of the first initialization transistor T1 is electrically connected to the initialization voltage terminal, and a source electrode of the first initialization transistor T1 is electrically connected to the first node N1. The initialization voltage terminal is used for providing an initial voltage V0.

A gate electrode of the second initialization transistor T6 is electrically connected to the second gate line G2, a source electrode of the second initialization transistor T6 is electrically connected to the initialization voltage terminal, and a drain electrode of the second initialization transistor T6 is electrically connected to the anode of O1.

A gate electrode of the first light-emitting control transistor T5 is electrically connected to the first light-emitting control line E1, a source electrode of the first light-emitting control transistor T5 is electrically connected to the power supply voltage terminal V2, and a drain electrode of the first light-emitting control transistor T5 is electrically connected to the second node N2. The power supply voltage terminal V2 is used for providing a power supply voltage V02.

A gate electrode of the second light-emitting control transistor T7 is electrically connected to the second light-emitting control line E2, a source electrode of the second light-emitting control transistor T7 is electrically connected to the drain electrode of the driving transistor T3, and a drain electrode of the second light-emitting control transistor T7 is electrically connected to the anode of O1.

The cathode of O1 is connected to the low voltage VSS.

In FIG. 7, a node labeled N4 is the fourth node electrically connected to the anode of O1.

In the pixel circuit of at least one embodiment of the present disclosure shown in FIGS. 7, T1 and T2 are n-type transistors, and T3, T4, T5, T6, and T7 are p-type transistors;

T1 and T2 are oxide transistors, and T3, T4, T5, T6 and T7 are low temperature polysilicon transistors.

In a specific implementation, T1 and T2 are set as oxide transistors, and the leakage current of the oxide transistors is small, so that the potential of N1 and the potential of N3 can be well maintained during the light-emitting phase.

When at least one embodiment of the pixel circuit of the present disclosure as shown in FIG. 7 operates, four scanning signals (the four scanning signals may be: the first gate driving signal, the second gate driving signal, the first light-emission control signal and) are employed, thereby threshold voltage compensation and light emission may be realized.

Figure 8:
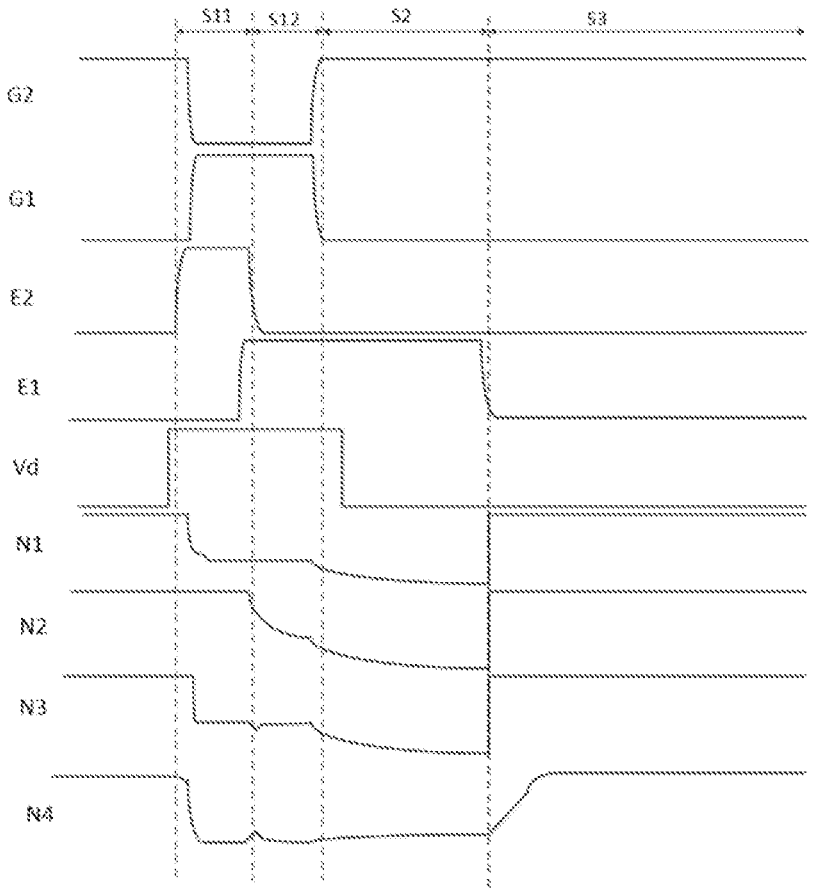
FIG. 8 is a timing diagram illustrating the operation of at least one embodiment of the pixel circuit shown in FIG. 7.

As shown in FIG. 8, in operation of at least one embodiment of the pixel circuit shown in FIG. 7 of the present disclosure, the display cycle may include a compensation phase, a writing phase S2 and a light-emitting phase S3 arranged in sequence. The compensation phase includes a first compensation period S11 and a second compensation period S12.

In the first compensation time period S11, G2 provides a low voltage signal, G1 provides a high voltage signal, E1 provides a low voltage signal, E2 provides a high voltage signal, and a data line D1 provides a data voltage Vd; T6 is on, T2 and T1 are on, T5 is on, the potential of N3 becomes Vd, and the potential of N2 becomes V02; the potential of N1 is V0, so that T3 can be turned on at the beginning of the second compensation period S12; N4 has a potential of V0 such that O1 does not emit light.

In the second compensation time period S12, G2 provides a low voltage signal, G1 provides a high voltage signal, E1 provides a high voltage signal and E2 provides a low voltage signal, a data line D1 provides a data voltage Vd, T5 is off, T6 is on, T7 is on, T2 is on, and T1 is on, and Vd charges C1 via the turned-on T2 to raise the potential of N2 until the potential of N2 becomes V0−Vth, where Vth is a threshold voltage of T3.

In the writing phase S2, G2 provides a high voltage signal, G1 provides a low voltage signal, E2 provides a low voltage signal, E1 provides a high voltage signal, T6 is off, T7 is on, T5 is off, T2 is off, T4 is on, T1 is off, N1 is in communication with N3, the potential of N2 remains V0−Vth, the potential of N1 and the potential of N3 are both Vd.

In the light-emitting phase S3, G2 provides a high voltage signal, G1 provides a low voltage signal, E2 provides a low voltage signal, E1 provides a low voltage signal, T6 is off, T1 and T2 are off, T4 is on, T5 and T7 are on, the potential of N2 jumps from V0−Vth to V02. Since the voltage difference across both ends of C1 cannot change abruptly, the potential of N3 changes to Vd+V02−V0+Vth, the potential of N1 also changes to Vd+V02−V0+Vth, and T3 is turned on so as to drive O1 to emit light.

In the light-emitting phase S3, the current value I1 of the drive current flowing through T3 is as follows:

I1=K(Vd−V0)2; where K is a current coefficient of T3.

It can be seen from the formula of I1 that the current value I1 of the drive current is independent of Vth and V02, and the threshold voltage can be compensated and the drive current can be made independent of the power supply voltage.

When at least one embodiment of the pixel circuit of the present disclosure as shown in FIG. 7 operates, T5 and T2 are turned on, so as to avoid Vd affecting the potential of N2, and improve circuit stability.

A pixel driving method according to at least one embodiment of the present disclosure, applied to the above-mentioned pixel circuit, where the display cycle includes a compensation phase and a writing phase which are arranged in sequence; the pixel driving method includes:

in the compensation phase, a data writing circuit writes the a voltage on a data line into a third node under control of a first gate driving signal; a first initialization circuit writes an initialization voltage V0 into a first node under control of a first gate driving signal; the energy storage circuit is charged by the data voltage so that a potential of a second node eventually becomes V0−Vth, where Vth is a threshold voltage of a driving transistor included in the driving circuit;

in the writing phase, an on-off control circuit controls communication between the first node and the third node under control of a first gate driving signal to write the data voltage to the first node.

In the pixel driving method according to at least one embodiment of the present disclosure, the display cycle includes a compensation phase and a writing phase sequentially arranged, in the compensation phase, the potential of the second node may be finally changed to V0−Vth to complete the threshold voltage compensation, and in the writing phase, the data voltage is written to the first node to complete the data writing.

Optionally, the pixel circuit further includes a first light-emitting control circuit; the display cycle further includes a light-emitting phase arranged after the writing phase; the pixel driving method further includes:

in the compensation phase, the driving circuit controls the communication between the first terminal of the driving circuit and the second terminal of the driving circuit under the control of the initialization voltage V0 connected to the control terminal thereof, charges the energy storage circuit via the data voltage so as to change the potential of the second node until the potential of the second node becomes V0−Vth, and the driving circuit disconnects the connection between the first terminal and the second terminal of the driving circuit; and in the light-emitting phase, the first light-emitting control circuit controls the communication between the power supply voltage terminal and the second node under the control of the first light-emitting control signal, the on-off control circuit controls the communication between the first node and the third node under the control of the first gate driving signal, and the driving circuit controls the generation of the drive current for driving the light-emitting element to emit light under the control of the potential of the control terminal thereof.

In a specific implementation, the pixel circuit may include a first light-emitting control circuit; in the compensation phase, the potential of the second node becomes V0−Vth; in the light-emitting phase, the first light-emitting control circuit controls communication between a power supply voltage terminal and the second node; an on-off control circuit controls communication between the first node and the third node; and the driving circuit drives the light-emitting element to emit light.

Optionally, the pixel circuit further includes a first light-emitting control circuit and a second light-emitting control circuit; the display cycle further includes a light-emitting phase arranged after the writing phase; the compensation phase includes a first compensation period and a second compensation period; the pixel driving method further includes:

in the first compensation time period, a first light-emitting control circuit controls communication between a power supply voltage terminal and a second node under the control of a first light-emitting control signal so as to write a power supply voltage into the second node;

in the second compensation time period, the second light-emitting control circuit controls the communication between the second terminal of the driving circuit and the light-emitting element under the control of the second light-emitting control signal, and the driving circuit controls the communication between the first terminal of the driving circuit and the second terminal of the driving circuit under the control of an initialization voltage V0 connected to the control terminal thereof, and charges the energy storage circuit via the data voltage so as to change the potential of the second node until the potential of the second node becomes V0−Vth, and the driving circuit disconnects the connection between the first terminal and the second terminal of the driving circuit;

in the writing phase, the second light-emitting control circuit controls the communication between the second terminal of the driving circuit and the light-emitting element under the control of the second light-emitting control signal; and in the light-emitting phase, the first light-emitting control circuit controls communication between the power supply voltage terminal and the second node under the control of the first light-emitting control signal, and the second light-emitting control circuit controls conduction between the second terminal of the driving circuit and the light-emitting element under the control of the second light-emitting control signal, so that the driving circuit can drive the light-emitting element to emit light.

In a specific implementation, the pixel circuit may include a first light-emitting control circuit and a second light-emitting control circuit, and during the first compensation time period, a power supply voltage is written into the second node; during the second compensation time period, the potential of the second node becomes V0−Vth; during the light-emitting phase, the first light-emitting control circuit controls communication between the power supply voltage terminal and the second node; the second light-emitting control circuit controls conduction between a second terminal of the driving circuit and the light-emitting element; and the driving circuit drives the light-emitting element to emit light.

In a specific implementation, the pixel circuit may further include a second initialization circuit; the pixel driving method may further include:

in the compensation phase, the second initialization circuit writes an initialization voltage into the first electrode of the light emitting element under the control of the second gate driving signal to control the light emitting element not to emit light.

A display panel according to at least one embodiment of the present disclosure includes a pixel circuit as described above.

A display device according to at least one embodiment of the present disclosure includes a display panel as described above.

A display device provided by at least one embodiment of the present disclosure may be any product or component having a display function such as a cell phone, a tablet computer, a television, a display, a notebook computer, a digital photo frame, and a navigator.

The above are merely the preferred embodiments of the present disclosure. A person skilled in the art may make further modifications and improvements without departing from the principle/spirit of the present disclosure, and these modifications and improvements shall also fall within the scope of the present disclosure.

What is claimed is:

1. A pixel circuit, comprising:

a light-emitting element, a driving circuit, a data writing circuit, an on-off control circuit, a first initialization circuit, and an energy storage circuit;

wherein, a control terminal of the driving circuit is electrically connected to a first node, a first terminal of the driving circuit is electrically connected to a second node, and a second terminal of the driving circuit is electrically connected to the light-emitting element; and the driving circuit is used for generating a drive current for driving the light-emitting element to emit light under control of a potential of the control terminal of the driving circuit;

a first terminal of the energy storage circuit is electrically connected to the second node, a second terminal of the energy storage circuit is electrically connected to a third node, and the energy storage circuit is used for storing energy;

the data writing circuit is electrically connected to a first gate line, a data line and the third node, and is used for writing data voltage on the data line into the third node under control of a first gate driving signal provided by the first gate line;

the on-off control circuit is electrically connected to the first gate line, the first node and the third node, and is used for controlling communication between the first node and the third node under the control of the first gate driving signal;

the first initialization circuit is electrically connected to the first gate line, the first node and an initialization voltage terminal, and is used for controlling writing an initialization voltage provided by the initialization voltage terminal into the first node under the control of the first gate driving signal; and a type of a transistor comprised in the first initialization circuit is different from a type of a driving transistor comprised in the driving circuit, and a type of a transistor comprised in the data writing circuit is different from the type of the driving transistor comprised in the driving circuit.

2. The pixel circuit according to claim 1, wherein the driving transistor is a low temperature polysilicon transistor, and the transistor comprised in the first initialization circuit and the transistor comprised in the data writing circuit are both oxide transistors.

3. The pixel circuit according to claim 1, wherein a type of a transistor comprised in the on-off control circuit is same as the type of the driving transistor comprised in the driving circuit.

4. The pixel circuit according to claim 1, further comprising:

a second initialization circuit; wherein the second terminal of the driving circuit is electrically connected to a first electrode of the light-emitting element, and a second electrode of the light-emitting element is electrically connected to a first voltage terminal; and the second initialization circuit is electrically connected to a second gate line, the initialization voltage terminal and the first electrode of the light-emitting element, and is used for writing the initialization voltage into the first electrode of the light-emitting element under the control of a second gate driving signal provided by the second gate line, so as to control the light-emitting element not to emit light.

5. The pixel circuit according to claim 4, wherein a type of a transistor comprised in the second initialization circuit is same as the type of the driving transistor.

6. The pixel circuit according to claim 4, wherein the second initialization circuit comprises a second initialization transistor;

a control electrode of the second initialization transistor is electrically connected to the second gate line, a first electrode of the second initialization transistor is electrically connected to the initialization voltage terminal, and a second electrode of the second initialization transistor is electrically connected to the first electrode of the light-emitting element; and the second initialization transistor is a low temperature polysilicon transistor.

7. The pixel circuit according to claim 1, further comprising:

a first light-emitting control circuit; wherein the first light-emitting control circuit is electrically connected to the second node, a power supply voltage terminal and a first light-emitting control line, and is used for controlling electrical connection between the power supply voltage terminal and the second node under control of a first light-emitting control signal provided by the first light-emitting control line.

8. The pixel circuit according to claim 7, further comprising:

a second light-emitting control circuit; wherein the second terminal of the driving circuit is electrically connected to the light-emitting element via the second light-emitting control circuit; and the second lighting control circuit is also electrically connected to a second light-emitting control line, and is used for controlling communication between the second terminal of the driving circuit and the light-emitting element under control of a second light-emitting control signal provided by the second light-emitting control line.

9. The pixel circuit according to claim 8, wherein the second light-emitting control circuit comprises a second light-emitting control transistor;

a control electrode of the second light-emitting control transistor is electrically connected to the second light-emitting control line, a first electrode of the second light-emitting control transistor is electrically connected to the second terminal of the driving circuit, and a second electrode of the second light-emitting control transistor is electrically connected to the light-emitting element; and the second light-emitting control transistor is a low temperature polysilicon transistor.

10. The pixel circuit according to claim 7, wherein the first light-emitting control circuit comprises a first light-emitting control transistor;

a control electrode of the first light-emitting control transistor is electrically connected to the first light-emitting control line, a first electrode of the first light-emitting control transistor is electrically connected to the power supply voltage terminal, and a second electrode of the first light-emitting control transistor is electrically connected to the second node; and the first light-emitting control transistor is a low temperature polysilicon transistor.

11. The pixel circuit according to claim 1, wherein the driving circuit comprises a driving transistor, the data writing circuit comprises a data writing transistor, the on-off control circuit comprises an on-off control transistor, the first initialization circuit comprises a first initialization transistor, and the energy storage circuit comprises a storage capacitor;

a control electrode of the driving transistor is electrically connected to the first node, a first electrode of the driving transistor is electrically connected to the second node, and a second electrode of the driving transistor is electrically connected to the light-emitting element;

a first terminal of the storage capacitor is electrically connected to the second node, and a second terminal of the storage capacitor is electrically connected to the third node;

a control electrode of the data writing transistor is electrically connected to the first gate line, a first electrode of the data writing transistor is electrically connected to the data line, and a second electrode of the data writing transistor is electrically connected to the third node;

a control electrode of the on-off control transistor is electrically connected to the first gate line, a first electrode of the on-off control transistor is electrically connected to the third node, and a second electrode of the on-off control transistor is electrically connected to the first node; and a control electrode of the first initialization transistor is electrically connected to the first gate line, a first electrode of the first initialization transistor is electrically connected to the initialization voltage terminal, and a second electrode of the first initialization transistor is electrically connected to the first node.

12. A display panel, comprising:

the pixel circuit according to claim 1.

13. A display device, comprising:

the display panel according to claim 12.

14. A pixel driving method, applied to a pixel circuit comprising:

a light-emitting element, a driving circuit, a data writing circuit, an on-off control circuit, a first initialization circuit, and an energy storage circuit;

wherein, a control terminal of the driving circuit is electrically connected to a first node, a first terminal of the driving circuit is electrically connected to a second node, and a second terminal of the driving circuit is electrically connected to the light-emitting element and the driving circuit is used for generating a drive current for driving the light-emitting element to emit light under control of a potential of the control terminal of the driving circuit;

a first terminal of the energy storage circuit is electrically connected to the second node, a second terminal of the energy storage circuit is electrically connected to a third node, and the energy storage circuit is used for storing energy;

the data writing circuit is electrically connected to a first gate line, a data line and the third node, and is used for writing data voltage on the data line into the third node under control of a first gate driving signal provided by the first gate line;

the on-off control circuit is electrically connected to the first gate line, the first node and the third node, and is used for controlling communication between the first node and the third node under the control of the first gate driving signal;

the first initialization circuit is electrically connected to the first gate line, the first node and an initialization voltage terminal, and is used for controlling writing an initialization voltage provided by the initialization voltage terminal into the first node under the control of the first gate driving signal; and a type of a transistor comprised in the first initialization circuit is different from a type of a driving transistor comprised in the driving circuit, and a type of a transistor comprised in the data writing circuit is different from the type of the driving transistor comprised in the driving circuit;

wherein a display cycle comprises a compensation phase and a writing phase in sequence; the pixel driving method comprises:

in the compensation phase, a data writing circuit writes data voltage on a data line into a third node under control of a first gate driving signal; a first initialization circuit writes an initialization voltage V0 into a first node under the control of the first gate driving signal; an energy storage circuit is charged by the data voltage so that a potential of a second node eventually becomes V0−Vth, wherein Vth is a threshold voltage of a driving transistor comprised in a driving circuit; and in the writing phase, an on-off control circuit controls communication between the first node and the third node under the control of the first gate driving signal to write the data voltage to the first node.

15. The pixel driving method according to claim 14, wherein the pixel circuit further comprises a first light-emitting control circuit; the display cycle further comprises a light-emitting phase after the writing phase; the pixel driving method further comprises: in the compensation phase, the driving circuit controls communication between a first terminal of the driving circuit and a second terminal of the driving circuit under the control of the initialization voltage V0 connected to a control terminal of the driving circuit, the energy storage circuit is charged by the data voltage so as to change the potential of the second node until the potential of the second node becomes V0−Vth, and the driving circuit disconnects the connection between the first terminal of the driving circuit and the second terminal of the driving circuit; and in the light-emitting phase, the first light-emitting control circuit controls communication between a power supply voltage terminal and the second node under control of a first light-emitting control signal, the on-off control circuit controls communication between the first node and the third node under the control of the first gate driving signal, and the driving circuit controls generation of a drive current for driving the light-emitting element to emit light under control of the potential of the control terminal of the driving circuit.

16. The pixel driving method according to claim 15, wherein the pixel circuit further comprises a second initialization circuit; the pixel driving method further comprises:

in the compensation phase, the second initialization circuit writes an initialization voltage into the first electrode of the light emitting element under the control of the second gate driving signal, so as to control the light emitting element not to emit light.

17. The pixel driving method according to claim 14, wherein the pixel circuit further comprises a first light-emitting control circuit and a second light-emitting control circuit; the display cycle further comprises a light-emitting phase after the writing phase; the compensation phase comprises a first compensation period and a second compensation period; and the pixel driving method further comprises:

in the first compensation time period, the first light-emitting control circuit controls communication between the power supply voltage terminal and the second node under the control of the first light-emitting control signal so as to write a power supply voltage into the second node;

in the second compensation time period, the second light-emitting control circuit controls communication between the second terminal of the driving circuit and the light-emitting element under control of a second light-emitting control signal, and the driving circuit controls communication between the first terminal of the driving circuit and the second terminal of the driving circuit under the control of the initialization voltage V0 input into the control terminal of the driving circuit, the energy storage circuit is charged by the data voltage so as to change the potential of the second node until the potential of the second node becomes V0−Vth, and the driving circuit disconnects the connection between the first terminal of the driving circuit and the second terminal of the driving circuit;

in the writing phase, the second light-emitting control circuit controls communication between the second terminal of the driving circuit and the light-emitting element under the control of the second light-emitting control signal; and in the light-emitting phase, the first light-emitting control circuit controls communication between the power supply voltage terminal and the second node under the control of the first light-emitting control signal, the second light-emitting control circuit controls conduction between the second terminal of the driving circuit and the light-emitting element under the control of the second light-emitting control signal, and the driving circuit drives the light-emitting element to emit light.

18. The pixel driving method according to claim 17, wherein the pixel circuit further comprises a second initialization circuit; the pixel driving method further comprises:

in the compensation phase, the second initialization circuit writes an initialization voltage into the first electrode of the light emitting element under the control of the second gate driving signal, so as to control the light emitting element not to emit light.

* * * * *